US006802542B2

(12) United States Patent
Laufer

(10) Patent No.: US 6,802,542 B2
(45) Date of Patent: Oct. 12, 2004

(54) UNLOCKING DEVICE FOR SUPPLEMENTAL DOOR LOCK

(76) Inventor: John B. Laufer, 1726 James St., Monroeville, PA (US) 15146

( * ) Notice: Subject to any disclaimer, the term of this patent is extended or adjusted under 35 U.S.C. 154(b) by 0 days.

(21) Appl. No.: 10/617,434

(22) Filed: Jul. 11, 2003

(65) Prior Publication Data

US 2004/0007883 A1 Jan. 15, 2004

Related U.S. Application Data

(63) Continuation of application No. 10/177,465, filed on Jun. 21, 2002, now abandoned.

(51) Int. Cl.[7] ..... E05C 19/00
(52) U.S. Cl. ..... 292/1; 292/262; 81/15.9
(58) Field of Search ..... 292/1, 262, 346, 292/DIG. 2; 81/15.9

(56) References Cited

U.S. PATENT DOCUMENTS 2,948,058 A * 8/1960 Culkosky ..... 29/227
2,966,053 A 12/1960 Mintz
3,134,252 A 5/1964 Mintz
4,048,873 A * 9/1977 Stevens ..... 81/15.9
4,079,642 A * 3/1978 Scott ..... 81/64
4,229,030 A 10/1980 Tarragona
4,252,218 A * 2/1981 Cowardin ..... 187/314
4,815,305 A 3/1989 Smith
4,876,927 A * 10/1989 Mullen ..... 81/15.9
5,018,415 A * 5/1991 Hawley ..... 81/15.9
5,285,666 A 2/1994 Bartnicki
5,875,660 A 3/1999 Olshousen
5,937,713 A * 8/1999 Walters ..... 81/15.9

* cited by examiner

*Primary Examiner*—Gary Estremsky
(74) *Attorney, Agent, or Firm*—Ronald S. Lombard

(57) ABSTRACT

An unlocking device for a supplemental door lock of the ball hook and U-shaped catch type is disclosed. The unlocking device consists of a thin elongated resilient member. The resilient member is designed to engage the perpendicular corner formed by the standard door stop and associated door jamb. The resilient member has a resilient integral compression recoil arm that exerts force on the U-shaped catch as the door is closed. Upon closing the door, the resilient member causes the U-shaped catch to release the ball hook.

16 Claims, 12 Drawing Sheets

UNLOCKING DEVICE FOR SUPPLEMENTAL DOOR LOCK

RELATED APPLICATION

This application is a continuation of and claims the benefit of U.S. application Ser. No. 10/177,465 filed Jun. 21, 2002, now abandoned which application is incorporated herein by reference in its entirety.

BACKGROUND OF THE INVENTION

The present invention relates to an unlocking device for a supplemental door lock, and, in particular, an unlocking device for a ball hook and U-shaped catch supplemental interior door lock such as used for a pedestrian door system.

Supplemental door locks have been used in residences, motels, hotels, and apartments, for example, for many years. A supplemental door lock typically works in conjunction with the primary door lock to permit the door to be opened partially from the inside to allow the occupant of the room, for example, to observe who is at the door, without permitting full access to the occupant's space. There may arise the situation where, for example, a child has operated or engaged the supplemental door lock and thereby preventing the parent from re-entering without damaging the door and frame. Alternatively, a situation may arise where the owner or operator of the apartment, hotel or motel, or public service officials, such as firemen or policemen, are required to enter the space where a supplemental door lock has been engaged. This may happen, for example, where someone falls asleep and a fire occurs in his space; the authorities in such a situation are unable to enter the occupant's space without damaging the door or door frame, because of the supplemental door lock.

Supplemental door locks including exterior unlocking means have been disclosed in the past. One such supplemental door lock incorporating means for unlocking it from outside the occupant's space is disclosed in U.S. Pat. No. 2,966,053, issued Dec. 27, 1960, to Albert E. Mintz. The Mintz patent discloses a safety door chain which may be locked and unlocked from the outside by authorized persons and may also be used in a normal way by persons on the inside. Another such supplemental door lock is disclosed in U.S. Pat. No. 3,134,252, issued May 26, 1964, to Albert E. Mintz. This patent discloses a supplemental door lock using a chain lock wherein the chain is secured at one end to a slide mounted on the door and at the other end to a key actuated lock positioned on the door frame permitting a key to be readily inserted from either inside the door or outside the door to unlock and release the chain. Another such lock is disclosed in U.S. Pat. No. 4,229,030, issued Oct. 21, 1980, to Francisco J. Tarragona Corbella which discloses a supplemental door lock including a catch member which may be operated from the outside of the door to disengage it from the retaining member. The Corbella patent uses a key on the outside of the door to rotate an arm thereby permitting the door to be unlocked.

Another such supplemental door lock which may be opened from the outside is disclosed in U.S. Pat. No. 4,815,305, dated Mar. 28, 1989, issued to William C. Smith. The Smith locking mechanism utilizes an auxiliary lock for safety chain type latch which may be used if the person desires to be able to pen the door from the outside by opening the lock. Another such supplemental door lock is disclosed in U.S. Pat. No. 5,285,666, issued Feb. 15, 1994, to Arthur W. Bartnicki. The Bartnicki patent discloses a combined deadlock and safety chain type door lock which provides means to shorten the length of the safety chain when the occupant is out of the room, but which may be opened by him from the outside when a key releases the lock. U.S. Pat. No. 5,875,660, dated Mar. 2, 1999, issued to Michael C. Olhousen teaches a chain door lock in which one of the chain links has been replaced by a coded color plastic tamperproof seal. The chain is provided with a locked cylinder which may be opened with a key from the outside.

It is apparent from the foregoing patents that various supplemental door locks have been provided with means for opening the supplemental door lock from outsides the occupant's space. This invention provides an exterior unlocking device for a ball hook and U-shaped catch supplemental door lock.

SUMMARY OF THE INVENTION

The present invention is provided in combination with a ball hook and U-shaped catch supplemental interior door lock for a pedestrian door system. Such a door system typically includes a door and doorway. The door, as is well known, includes an exterior front, an interior back and vertical sides between the front and back of the door. The door has an open position and a closed position relative to the doorway. The doorway includes oppositely disposed vertical side jambs. The door is hinged to one of the vertical side jambs. The side jambs carry a door stop forming an L-shaped lip to receive the vertical sides of the door when in the closed position. The L-shaped lip includes a substantially perpendicular corner and has one surface substantially parallel to the front of the door when in the closed position and another surface substantially parallel to the vertical sides of the door when in the closed position.

The ball hook and U-shaped catch door lock typically includes a pivoting U-shaped catch, which is mounted at one end to the doorway. The catch includes a catch mounting base attached to the doorway and a pivoting U-shaped member hinged to the mounting base. The U-shaped member is pivotally mounted at one end to the catch mounting base. A ball hook is mounted to the back of the door in operative relationship with the U-shaped member, as is well known.

The ball hook includes a curved arm and a ball hook integral mounting base at one end of the curved arm. The ball hook mounting base is attached to the back of the door. The ball hook also includes an integral ball-shaped tip at the other end of the curved arm. The U-shaped member has opposite leg portions extending from the trough of the U-shaped member. The opposite leg portions initially extend in substantial parallel relationship from the trough of the U-shaped member a predetermined length to have a door locking portion between the parallel opposite leg portions. The parallel opposite leg portions then abruptly diverge proximate the catch mounting base to have a door unlocking portion there between adjacent the door locking portion. The door unlocking portion is sized to permit the ball-shaped tip to pass freely through the U-shaped member. The door locking portion is sized to slidably engage the curved arm of the ball hook and to prevent the ball-shaped tip from passing through the U-shaped member. The supplemental interior door lock as described is well known and in wide spread use in residences, motels, hotels, and apartments, for example.

The present invention provides an unlocking device consisting of a single thin flat elongated resilient member for insertion exteriorly between the door and the one vertical side jamb. The resilient member at the proximal end is provided with a front of door contact portion for contacting the front of the door and a handle portion diverging from the front of door contact portion for permitting grasping of the handle portion exteriorly of the door. The resilient member in the operative position between the door and the one vertical side jamb longitudinally retroverts adjacent the front of door contact portion to form a door stop corner contact edge. The resilient member then extends longitudinally arcuately towards the side of the door and in contact therewith and then turns toward the catch mounting base to form an integral vertical side of door arched contact portion. The resilient member then extends from the arched contact portion at the distal end thereof longitudinally turning abruptly away from the catch mounting base to form an integral compression recoil arm fulcrum corner. The resilient member from the compression recoil fulcrum corner arcuately extends away from the catch mounting base affixed to the doorway to form an integral compression recoil arm of predetermined length. The compression recoil arm at the distal end thereof is provided with a first uniform linear transverse contact surface.

With the unlocking device in the operative position between the door and the one vertical side jamb, the door stop corner contact edge is pressed into engagement with the door stop as the door is exteriorly closed and the side of door arched contact portion is laterally compressed between the door the one vertical side jamb as the compression recoil arm is compressed towards the back of the door by and in contact with the U-shaped member as the door is about fully closed. Whereupon, the integral ball-shaped tip of the ball hook enters the door unlocking portion of the U-shaped member as a result of about full closure of the door. The U-shaped member instantaneously and forcefully recoils out of operative engagement with the U-shaped member.

In one embodiment, the first transverse contact surface of the compression recoil arm is in operative alignment with one opposite leg portion of the U-shaped member. In the second embodiment, the first transverse contact surface has sufficient width to contact both opposite leg portions of the U-shaped member simultaneously.

In another embodiment, the compression recoil arm has a curved arm receiving slot therein of predetermined dimensions. The curved arm receiving slot divides the integral compression recoil arm to form a pair of compression recoil arm finger members. A first of the recoil finger members is provided with a second uniform linear transverse contact surface at the distal end thereof for contacting one of the opposite leg portions of the pivoting U-shaped member and a second of the recoil finger members is provided with a third uniform linear contact surface at the distal end thereof for contacting other opposite leg portion of the pivoting U-shaped member.

Preferably, the one finger member and the other finger member of the pair of finger members each have a length about equal to the length of the door locking portion of the U-shaped member.

It is desirable that the handle portion of the resilient member have an offset grip portion of reduced width which preferably carries a hand protective layer.

Preferably, the second uniform linear transverse contact surface and the third uniform linear transverse contact surfaces each have a width greater than the width of the parallel opposite leg portions of the U-shaped member.

Preferably, the curved arm receiving slot of the compression recoil arm has sufficient length to permit about full closure of the door when the door lock is engaged. Also, desirably the curved arm receiving slot of the compression recoil arm has a tapered width to accommodate the curved arm having an increase in width from the ball hook to the mounting base Preferably, the thin flat elongated resilient member has sufficient resiliency to permit said integral compression recoil arm in the operative position to deflect towards the back of the door to permit the ball hook to enter the door unlocking portion and to recoil out of operative engagement with the U-shaped member. Desirably, the thin flat elongated resilient member is made of rolled tempered steel of predetermined thickness.

The compression recoil arm finger members desirably extend longitudinally from the compression recoil arm fulcrum corner in an arch. Desirably, the distal end of each of the recoil arm members is retroverted in operative position back towards the catch mounting base.

The compression recoil arm fulcrum corner preferably forms a longitudinal fulcrum corner interior angle of from about 140 degrees to about 150 degrees between the side of door arched contact portion and the compression recoil arm when not in operative engagement with the door lock.

The door stop contact corner desirably forms a longitudinal door stop corner interior angle of from about 80 degrees to about 90 degrees between the front of door contact portion and the side of door arched contact portion.

Preferably, the handle portion diverges from the front of door contact portion at an angle of from about 30 degrees to about 45 degrees. Preferably the offset grip portion of the handle portion has a width less than the front of door contact portion.

BRIEF DESCRIPTION OF THE DRAWINGS

For a better understanding of the invention, reference may be had to the accompanying drawings exemplary of the invention in which.

BRIEF DESCRIPTION OF THE PREFERRED EMBODIMENTS

Figure 1:
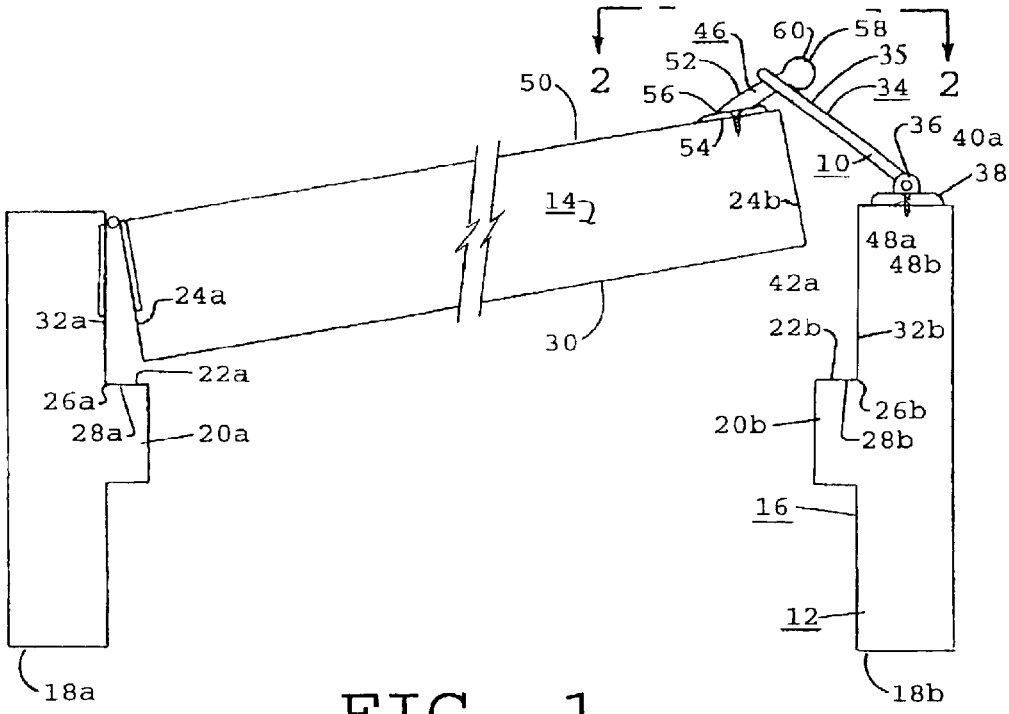
FIG. 1 is a top plan view of a door system, partially open, with a ball hook and U-shaped catch supplemental interior door lock.
Figure 11:
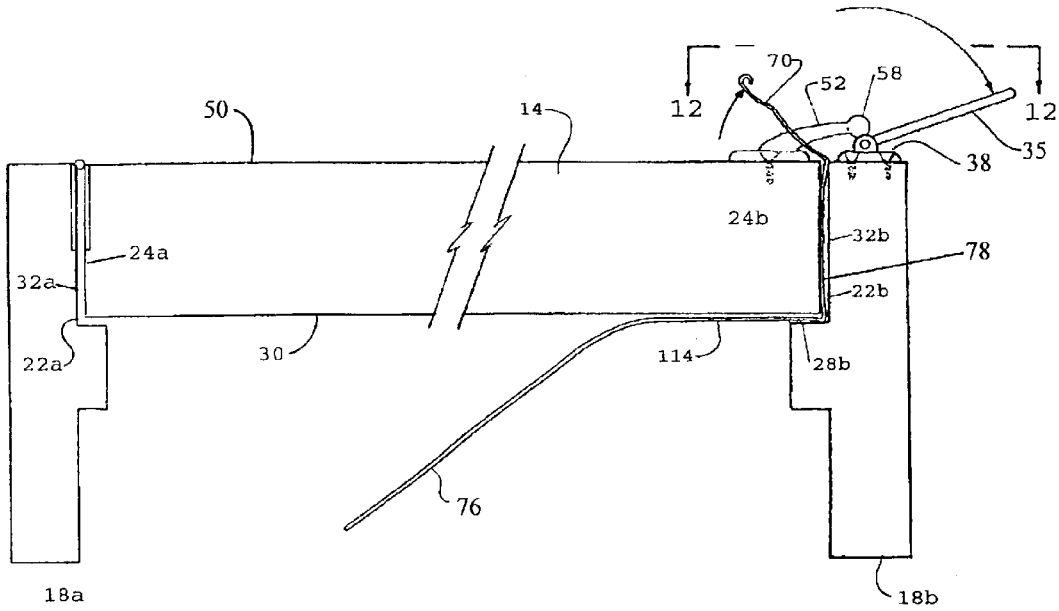
FIG. 11 is a top plan view as shown in FIG. 9 showing the position of the unlocking device with the door fully closed and the U-shaped catch released from the ball-shaped tip; and, FIG. 12 is a sectional view taken along the line 12—12 of FIG. 11.

With reference to FIG. 1, there is shown a ball hook and U-shaped catch supplemental interior door lock 10 for a pedestrian door system 12. The door system includes a door 14 and doorway 16. The door 14 includes an exterior front 30, an interior back 50, and vertical sides 24*a*, 24*b* between the front 30 and back 50 of the door 14. The door 14 has an open position as shown in FIG. 1, for example, and a closed position as shown in FIG. 11, relative to the doorway 16. The doorway includes a oppositely disposed vertical side jambs 18*a*, 18*b*. The side jambs 18*a*, 18*b* carry a door stop 20*a*, 20*b* forming a L-shaped lip 22*a*, 22*b* to receive the vertical sides 24*a*, 24*b* of the door 14 when in the closed position. The L-shaped lip 22*a*, 22*b* includes a substantially perpendicular corner 26*a*, 26*b*. The L-shaped lip 22*a*, 22*b* has one surface 28*a*, 28*b* substantially parallel to the front 30 of the door 14 when in the closed position as shown in FIG. 11, for example, The other surface 32*a*, 32*b* of the L-shaped lip 22*a*, 22*b* respectively being substantially parallel to the vertical sides 24*a*, 24*b* of the door 14 when in the closed position, as shown in FIG. 11, for example. The door system described thus far is conventional.

Figure 2:
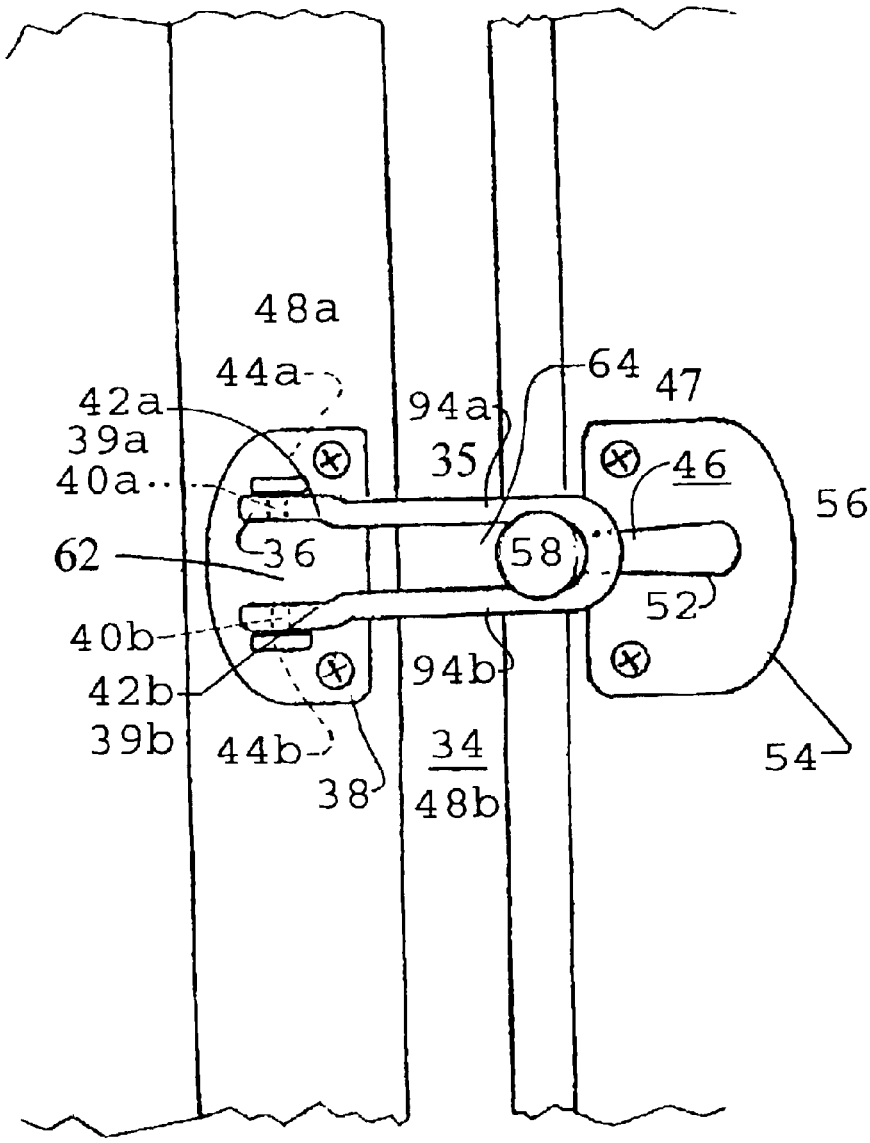
FIG. 2 is a sectional view taken along the line 2—2 of FIG. 1.

The ball hook and U-shaped catch supplemental interior door lock 10 as shown in FIGS. 1 and 2, for example, typically includes a pivoting U-shaped catch 34. The catch includes a catch mounting base 38 attached to the doorway 16 and a pivoting U-shaped member 35 hinged to the mounting base 38. The U-shaped member 35 is mounted at one end 36 to the doorway 16 by catch mounting base 38 as shown in FIG. 2. Pins 40*a*, 40*b* extend through first apertures 39*a*, 39*b* at the one end 36 of the U-shaped member 35. The pins 40*a*, 40*b* pass through flanges 42*a*, 42*b* fixed to the mounting bracket 38. The flanges 42*a*, 42*b* are provided with apertures 44*a*, 44*b*, respectively. This arrangement is conventional and permits the U-shaped member 35 to pivot freely when not engaged with the ball hook 46. The catch mounting base 38 may be attached to vertical side jamb 18*b* by screws 48*a*, 48*b* as is well known in the art. The ball hook 46 is mounted to the door 14 on the back 50 of the door 14 in operative relationship with the U-shaped catch 34. The ball hook includes a curved arm 52 which typically has a tapered width as shown in FIG. 2. Ball hook 46 also preferably includes an integral ball hook mounting base 54 proximate one end 56 of the curved arm 52. Mounting base 54 is attached to the door by screws 51*a*, 51*b*, for example. The ball hook 46 includes an integral ball shaped tip 58 proximate the other end 60 of the curved arm 46.

Figure 12:
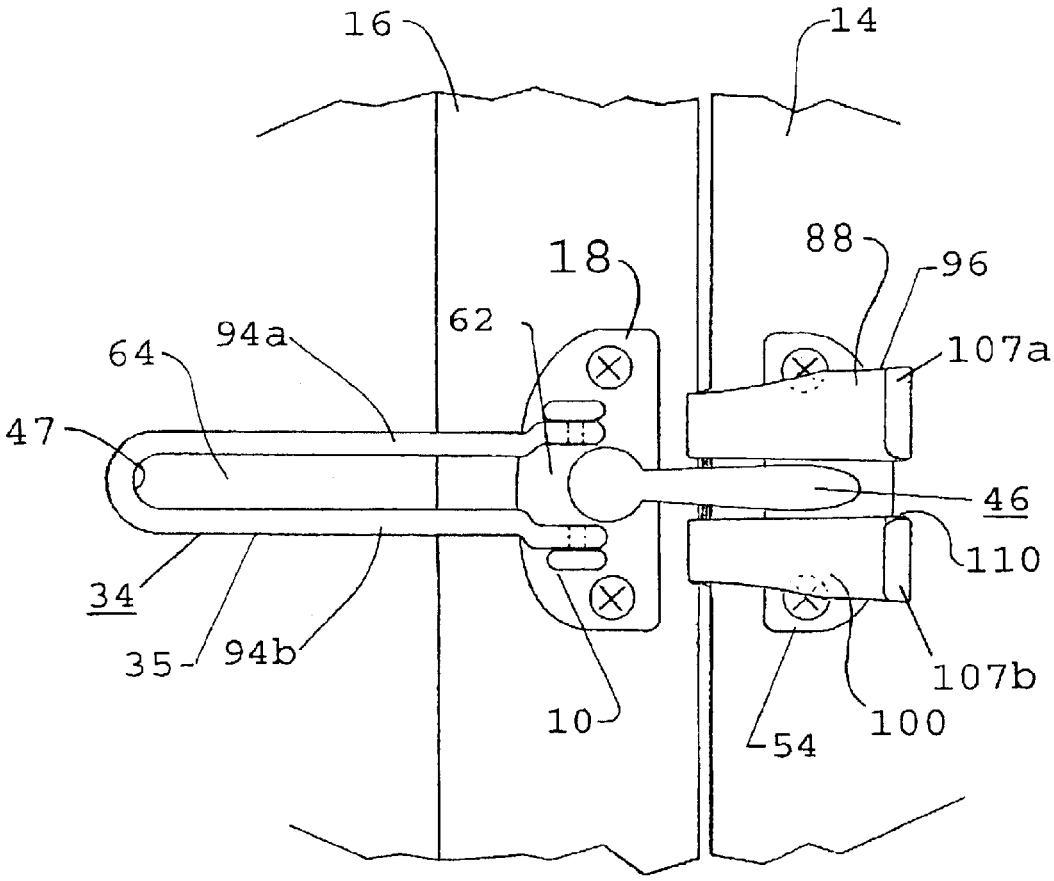

Referring to FIGS. 2 and 12, the U-shaped member 35 has opposite leg portions 94*a*, 94*b* extend initially in substantial parallel relationship from the trough 47 of U-shaped member 35 a predetermined length to have a door locking portion 64 between the parallel opposite leg portion, 94*a*, 94*b*. The parallel opposite leg portions 94*a*, 94*b* then abruptly diverge proximate the catch mounting base 38 to have a door unlocking portion 62 between the opposite leg portions 94*a*, 94*b*. The door unlocking portion 62 is sized to permit the ball shaped tip 58 to pass freely through the U-shaped member 35 to permit the door 14 to be opened, which only occurs upon the door being in a fully closed position The door locking portion 64 is sized to slidably engage the curved arm 52 of the ball hook 46 and sized to prevent the ball-shaped tip 58 from passing through the U-shaped member 35, when the lock is engaged and the door is opened. The supplemental interior door lock 10 and door system 12 thus far described is conventional. With reference to FIGS. 3–12, there is shown unlocking device 66 of the present invention which consists of a single thin elongated resilient member 68 for insertion exteriorly between the door 14 and one vertical side jamb 18*b*. The resilient member 68 at the proximal end 69 is provided with a front of door contact portion 114, as shown in FIGS. 3–6, for contacting the front exterior 30 of the door 14 and a handle portion 76 diverging from the front of door contact portion for permitting ease in gasping the member 68 exteriorly of the door 14.

Figure 4:
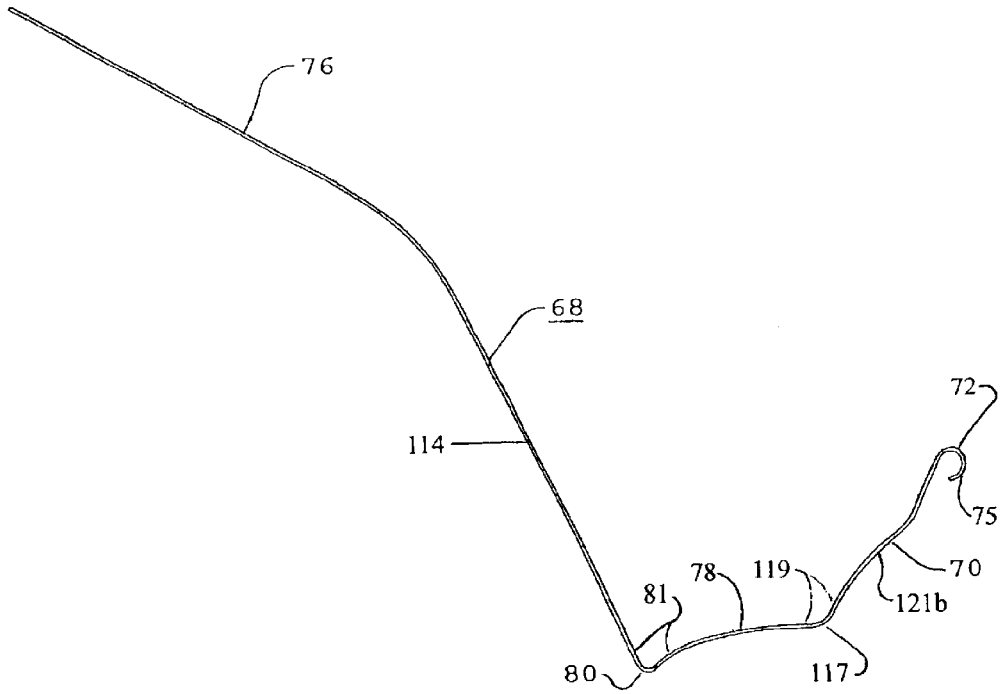
FIG. 4 is a side elevational view of the one embodiment shown in FIGS. 3, 5 and 6.
Figure 5:
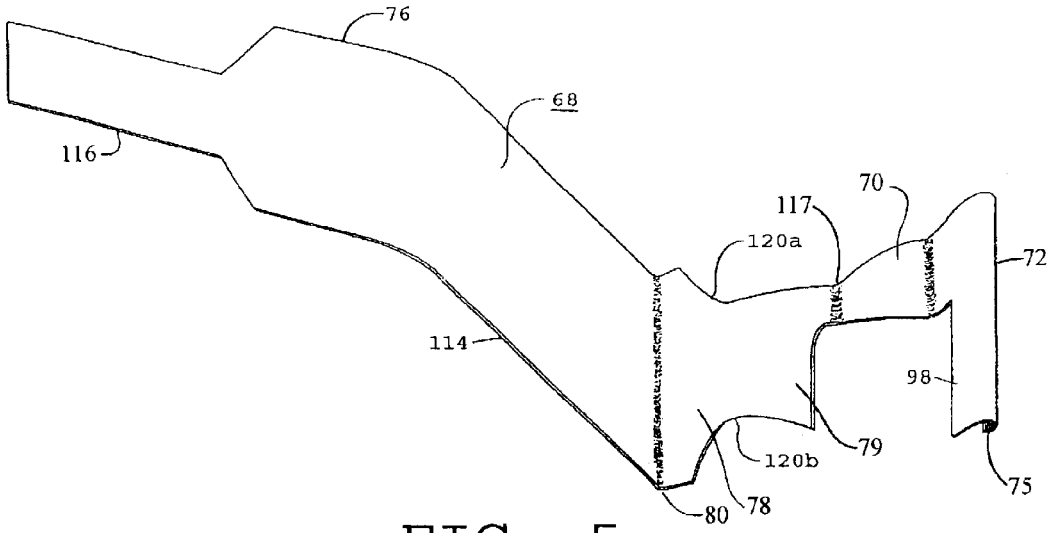
FIG. 5 is a perspective view of a second embodiment of the present invention.
Figure 9:
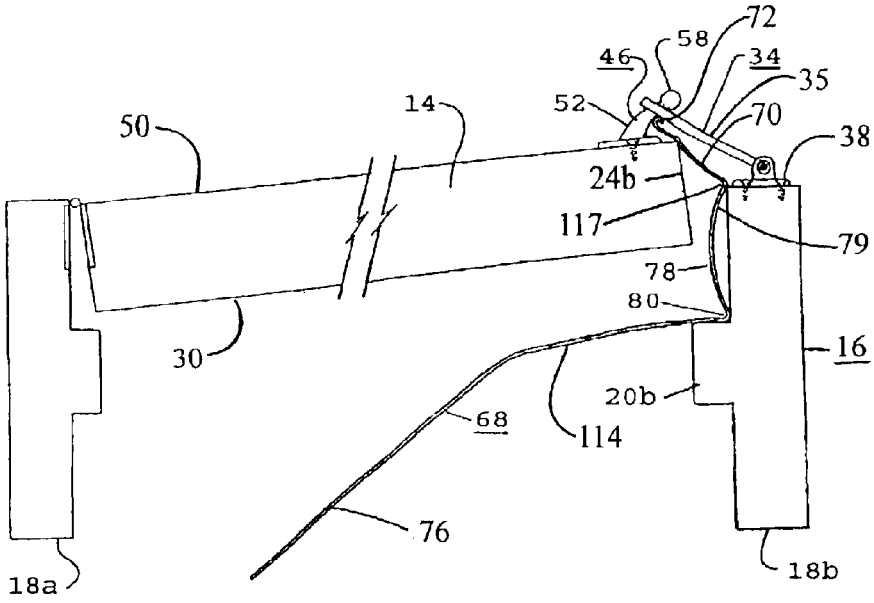
FIG. 9 is a top plan view of the door system as shown in FIG. 7 with the unlocking device of the present invention in the initial position to engage the ball hook and U-shaped catch interior door lock.
Figure 10:
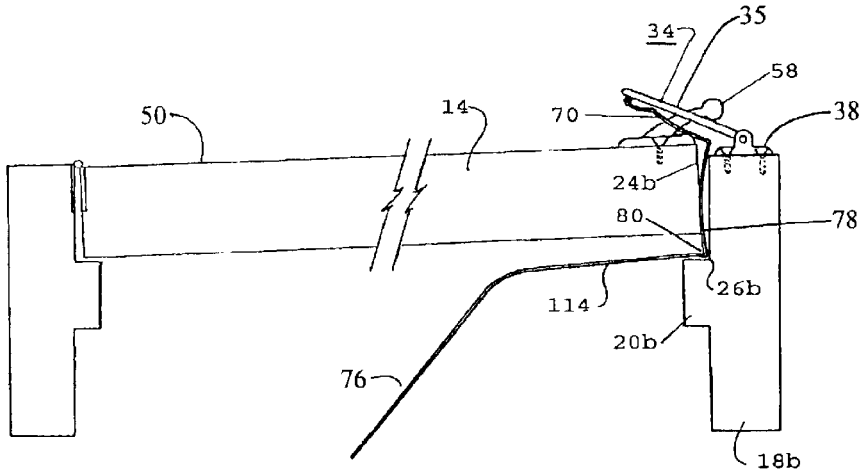
FIG. 10 is a top plan view of the door system shown in FIG. 9 with the door shown in almost a closed position with the unlocking device engaging the U-shaped catch.

The resilient member 68 in the operative position between the door 14 and the one vertical side jamb 18*b* longitudinally retroverts adjacent the front of door contact portion 114 to form a door stop corner contact edge 80. As shown in FIG. 9, the resilient member 68 then extends longitudinally arcuately towards the side of the door 24*b* and in contact there with and then turns toward the catch mounting base 38 to form an integral vertical side of door arched contact portion 78. The resilient member then extends from the arched contact portion 78 at the distal end 79 thereof longitudinally turning abruptly away from the catch mounting base 38 to form an integral compression recoil arm fulcrum corner 117. The resilient member 68 from the compression recoil fulcrum corner 117 arcuately extends away from the catch mounting base 38 affixed to the doorway 16 to form an integral compression recoil arm 70 of predetermined length. The compression recoil arm 70 at the distal end 72 thereof provided with a first uniform linear transverse contact surface 75, as shown in FIGS. 3–5.

With the unlocking device 66 in the operative position between the door 14 and the one vertical side jamb 18*b* the door stop corner contact edge 80 is pressed into engagement with the door stop 20*b* as the door 14 is exteriorly closed and the side of door arched contact portion 78 is laterally compressed between the door 14 and the one vertical side jamb 18*b* as the compression recoil arm 70 is compressed towards the back 50 by and in contact with the U-shaped member 35 as the door 14 is about fully closed. Whereupon, the integral ball-shaped tip 58 of the ball hook 46 enters the door unlocking portion 62 of the U-shaped member 35 as a result of about full closure of the door 14. The U-shaped member 35 instantaneously and forcefully recoils out of operative engagement with the U-shaped member 35, as shown in FIGS. 9–12.

Figure 3:
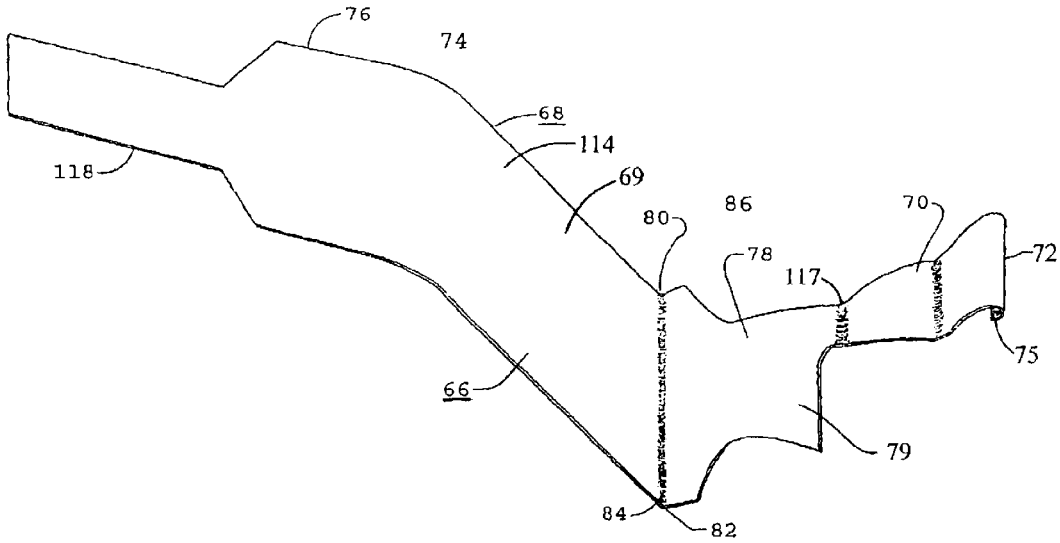
FIG. 3 is a perspective view of one embodiment of the unlocking device of the present invention.

Preferably, in one embodiment, see FIG. 3, the first uniform linear transverse contact surface 75 is designed for operative alignment with one of the opposite leg portions 94*a*, 94*b*. In a second embodiment the first uniform linear transverse contact surface 75 has sufficient width, as shown in FIG. 5 to contact both opposite leg portions 94*a*, 94*b*, simultaneously.

In another embodiment, as shown in FIGS. 7–12, the compression recoil arm 70 has a curved arm receiving slot 102 therein of predetermined dimensions. The curved arm receiving slot 102 divides the integral compression recoil arm 70 to form a pair of compression recoil arm finger members. A first of the recoil finger members 88 is provided with a second uniform linear transverse contact surface 107*a* at the distal end 96 thereof for contacting one of the opposite leg portions 94*a* of the pivoting U-shaped member 35 and a second of the recoil finger members 100 is provided with a third uniform linear contact surface 107*b* at the distal end 110, thereof, for contacting the other opposite leg portion 94*b* of the pivoting U-shaped member 35.

Preferably, the second uniform linear contact surface 107*a* and the third uniform linear contact surface 107*b* each have a width greater than the width of the parallel opposite leg portions 94*a*, 94*b* of the U-shaped member 35, as shown in FIG. 12.

The curved arm receiving slot 102 of the compression recoil arm 70 preferably has sufficient length to permit about full closure of the door 14 when the door lock 10 is engaged. Also, desirably the curved arm receiving slot 102 of the compression recoil arm 70 has a tapered width as shown in FIG. 6 to a accommodate the curved arm 52 having an increase in width from the ball hook to the mounting base 54.

The thin flat elongated resilient member 68 has sufficient resiliency to permit said integral compression recoil arm 70 in the operative position to deflect towards the back 50 of the door 14 to permit the ball hook 46 to enter the door unlocking portion 62 and to recoil out of engagement with the U-shaped member 35. Desirably, the then flat elongated resilient member 68 is made of rolled tempered steel of predetermined thickness.

Figure 6:
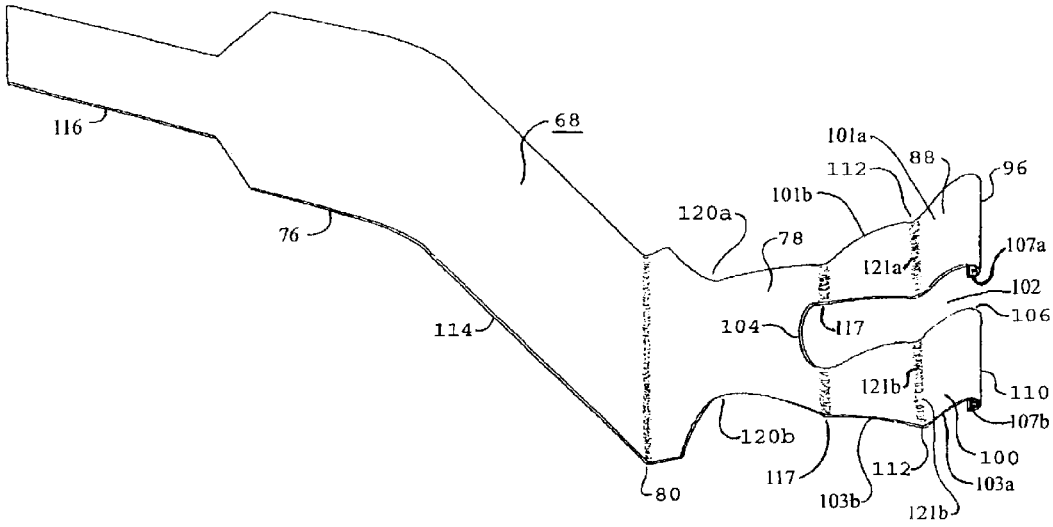
FIG. 6 is a perspective view of another embodiment of the unlocking device of the present invention.
Figure 7:
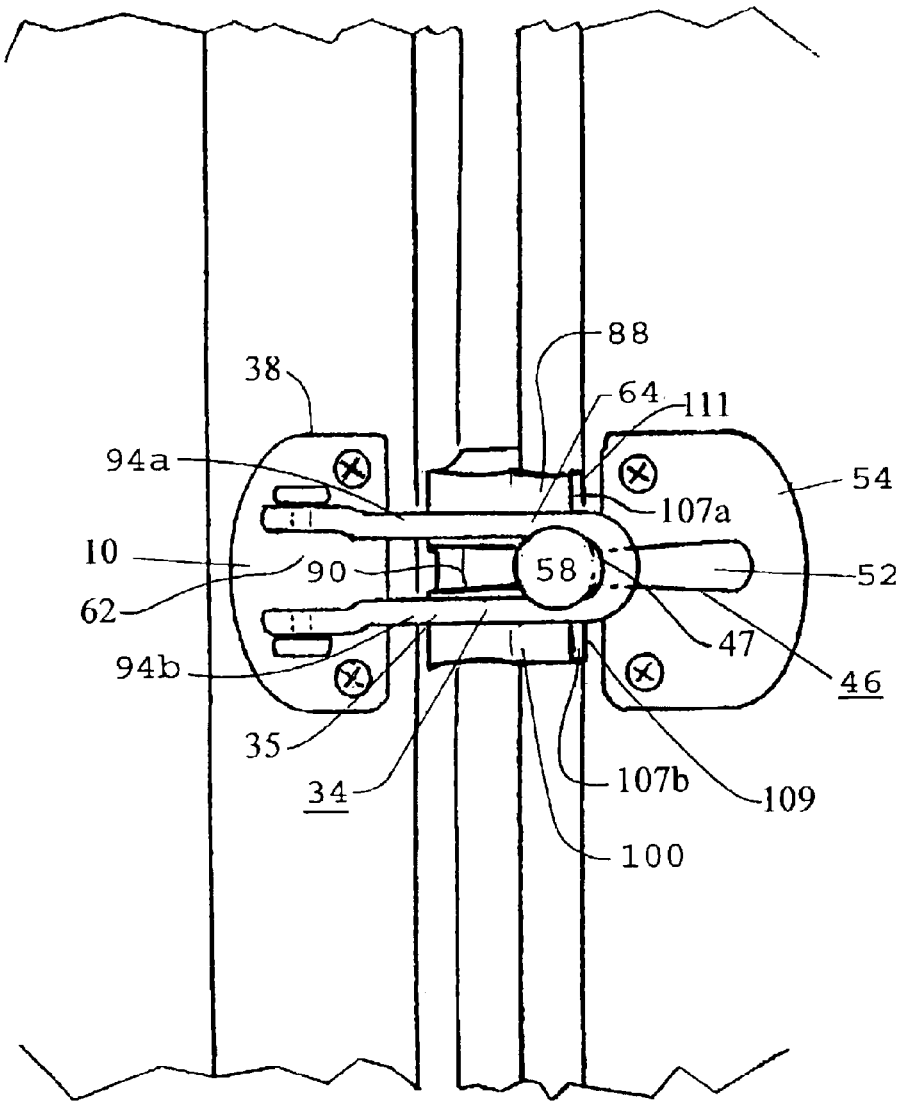
FIG. 7 is the same view as shown in FIG. 2 with the unlocking device of the present invention engaging the ball hook and U-shaped catch supplemental interior door lock.
Figure 8:
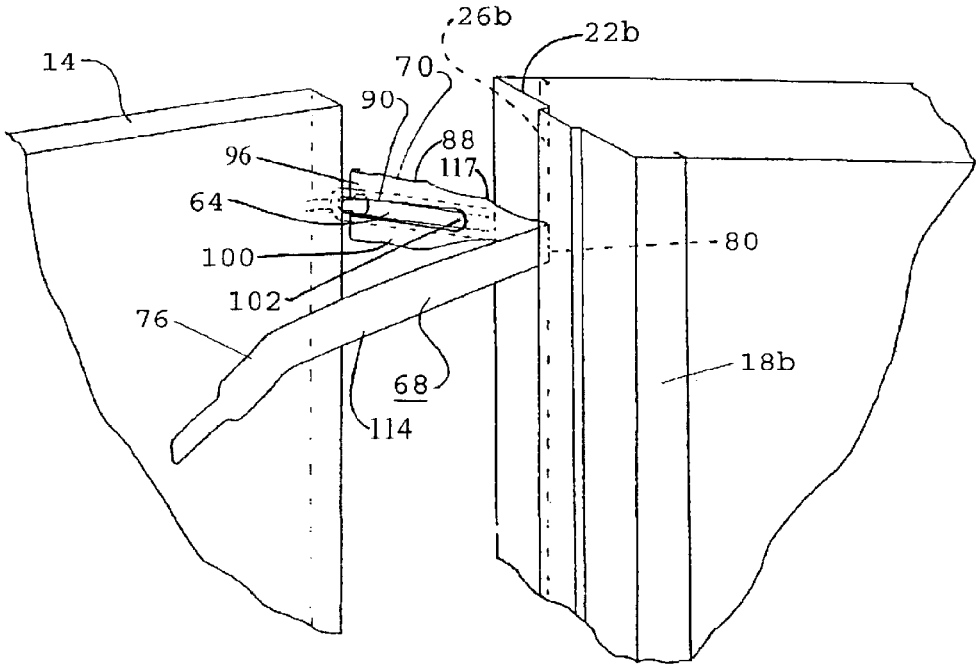
FIG. 8 is a perspective view of the present invention engaging the interior door lock as shown in FIG. 7.

The compression recoil arm finger members 88, 100, desirably extend longitudinally from the compression recoil-arm fulcrum corner 117 in an arch 121*a*, 121*b*, as shown in FIGS. 4–6. Desirably, the distal ends 96, 110 of each of the recoil arm members 88, 100 are retroverted in operatively position back towards the catch mounting base as shown in FIG. 12.

The compression recoil arm fulcrum corner 117 preferably forms a longitudinal fulcrum corner interior angle 119 of from about 140 degrees to about 150 degrees between the side of door arched contact portion 78 and the compression recoil arm 70 when not in operative engagement with the door lock, as shown in FIG. 4.

The door stop contact corner 80 desirably forms a longitudinal door stop corner interior angle 81 of from about 80 degrees to about 90 degrees between the front of door contact portion 114 and the side of door arched contact portion 78, as shown in FIG. 4.

Preferably, the handle portion 116 diverges from the front of door contact portion at an angle of about 30 degrees to about 45 degrees. Preferably the handle portion 116 is provided with an offset grip portion 118 which has a width less than the front of door contact portion, as shown in FIGS. 3 and 5 for easy grasping of the device 66.

Preferably, the one resilient finger member 88 and the other resilient finger member 100 each include a first bend 112 therein proximate the midpoint thereof. With reference to FIG. 6, the first bend divides the one finger member 88 proximate the midpoint thereof into a first part 101*a* and a second part 101*b* and divides the other finger member 100 proximate the midpoint thereof into a third part 103*a* and a fourth part 103*b* to form longitudinal arches 121*a*, 121*b*. The arches 121*a*, 121*b* cause the recoil force to increase as the door 14 is closed and the one transverse contact surface 107*a* and the other transverse contact surface 107*b* are caused to engage the U-shaped member 35. Preferably, the first part 101*a* of the one finger member 88 forms from about 155 degree to about 165 degree angle with the second part 101*b* of the one finger member 88. Preferably, the third part 103*a* of the other finger member 100 forms from about 155 degree to about 165 degree angle with the fourth part 103*b* of the other finger member 100. Preferably, the one finger member 88 and the other finger member 100 each have a length about equal to the length of the door locking portion 64 of the U-shaped member 35.

As stated, the elongated resilient member 68 may be made of rolled tempered steel, such as, the steel commonly used as a banding product which may be 2½ inches wide, for example. The thickness of the resilient member 68 is limited to the width of the space between the side of the door 20*b* and the vertical side jamb 18*b* when the door is completely closed. A tempered steel with a 0.20 gauge thickness may be used, for example.

Preferably, the front of door contact portion 114 is of predetermined length adjacent the corner contact bend 80, as shown in FIG. 6. The handle portion 76, in the operative position, may form longitudinally about a 30 to about a 45 degree exterior angle, not shown, with the front of door contact portion 114, for example. Preferably, the ratio of the length of the front of door contact portion 114 to the handle portion 76 is from about 1:1 to about 1:3.

Preferably, the offset grip position 116 of the handle portion 76 carries a hand protective layer 121 such as rubber or plastic to protect the hand when the device is being used. As shown in FIG. 6, for example, a portion of handle portion 76 may be offset grip portion 116 with a narrow grip to more easily accommodate a person's hand.

For example, the over all length of the resilient member 68 before bending may be 11¼ inches. The side of door arched contact portion 78 may be about 2 inches in length and the compression recoil arm 70 may be 2.375 inches, for example. It is recommended that the door arch contact portion 78 have a longitudinal curve as shown in FIG. 4, as opposed to straight, which has been found to add to the resiliency of the spring factor of the device. A deviation of approximately ⅛ inch in deflection per linear inch between points has been found to be effective.

Notches 120*a*, 120*b* of side of door arched contact portion 78, may be included as shown to obtain the resiliency desired. With a 2½ inch wide 0.20 gauge spring steel the notches are cut out to a depth of 0.625 inches, for example.

It is of course understood that the invention is not limited to the embodiments described, but is susceptible to alteration or modification and substitution of the elements described herein without departing from the spirit of the invention.

What is claimed is:

1. An unlocking device for exteriorly unlocking and in combination with a ball hook and U-shaped catch supplemental interior door lock for a pedestrian door system, said door system including a door and doorway, said door including an exterior front, an interior back and vertical sides between said front and said back of said door, said door having an open position and a closed position relative to said doorway, said doorway including oppositely disposed vertical side jambs, said door hinged to one of said vertical side jambs, said side jambs carrying a door stop forming an L-shaped lip to receive said vertical sides of the door when in the closed position, said L-shaped lip including a substantially perpendicular corner, said L-shaped lip having one surface substantially parallel to the front of said door when in the closed position and said L-shaped lip having another surface substantially parallel to the vertical sides of said door when in the closed position, said door lock including a pivoting U-shaped catch, said catch including a catch mounting base affixed to said doorway and a pivoting U-shaped member hinged to said catch mounting base, said U-shaped member pivotally mounted at one end to said catch mounting base, a ball hook mounted to said door on the back of said door in operative relationship with said U-shaped member, said ball hook including a curved arm, said ball hook including an integral ball hook mounting base proximate one end of said curved arm, said ball hook mounting base affixed to said door, said ball hook including an integral ball-shaped tip proximate the other end of said curved arm, said U-shaped member having opposite leg portions extending from the trough of the U-shaped member, said opposite leg portions initially extending in substantial parallel relationship from said trough of said U-shaped member a predetermined length to have a door locking portion between said parallel opposite leg portions, said parallel opposite leg portions then abruptly diverging proximate said catch mounting base to have a door unlocking portion there between adjacent said door locking portion, said door unlocking portion sized to permit said ball-shaped tip to pass freely through said U-shaped member, said door locking portion sized to slidably engage said curved arm of said ball hook and sized to prevent said ball-shaped tip from passing through said U-shaped member, said unlocking device consisting of:

a. a single thin flat elongated resilient member for insertion exteriorly between said door and said one vertical side jamb;

b. said resilient member at the proximal end thereof provided with a front of door contact portion for contacting the front of said door and a handle portion diverging from said front of door contact portion for permitting grasping of said handle portion exteriorly of said door;

c. said resilient member in the operative position between said door and said one vertical side jamb, longitudinally retroverting adjacent said front of door contact portion forming a door stop corner contact edge;

d. said resilient member in the operative position between said door and said one vertical side jamb, then extending longitudinally arcuately towards said vertical side of door and in contact therewith and then turning towards said catch mounting base forming an integral vertical side of door arched contact portion;

e. said resilient member in the operative position between said door and said one vertical side jamb, then extending from said arched contact portion at the distal end thereof longitudinally turning abruptly away from said catch mounting base forming an integral compression recoil arm fulcrum corner;

f. said resilient member in the operative position between said door and said one vertical side jamb, arcuately extending longitudinally from said compression recoil fulcrum corner away from said catch mounting base affixed to said doorway to form an integral recoil compression arm of predetermined length;

g. said compression recoil arm at the distal end thereof provided with a first uniform linear transverse contact surface of predetermined width for contacting said pivoting U-shaped member of said supplemental interior door lock; and, whereby, with said unlocking device in the operative position between said door and said one vertical side jamb, said door stop corner contact edge is pressed into engagement with said door stop as said door is exteriorly closed and said side of door arched contact portion is laterally compressed between said door and said one vertical side as said compression recoil arm is compressed towards the back of said door by and in contact with said U-shaped member as said door is about fully closed, whereupon said integral ball-shaped tip of said ball hook entering said door unlocking portion of said U-shaped member as a result of about full closure of said door, said U-shaped member instantaneously and forcefully recoils out of operative engagement with said U-shaped member.

2. The unlocking device of claim 1, wherein said first uniform linear transverse contact surface of said distal end of said compression recoil arm is of sufficient width to contact simultaneously both of said opposite leg portions of said U-shaped member.

3. The unlocking device of claim 1, wherein said compression recoil arm has a curved arm receiving slot therein of predetermined dimensions, said curved arm receiving slot dividing said integral compression recoil arm to form a pair of compression recoil arm finger members, a first of said recoil finger members provided with a second uniform linear transverse contact surface at the distal end thereof for contacting one of said opposite leg portions of said pivoting U-shaped member, a second of said recoil finger members provided with a third uniform linear transverse contact surface at the distal end thereof, for contacting the other said opposite leg portions of said pivoting U-shaped member.

4. The unlocking device of claim 3, wherein said second uniform linear transverse contact surface and said third uniform linear transverse contact surface each have a width greater than the width of said door unlocking portion of said parallel opposite leg portions of said U-shaped member.

5. The unlocking device of claim 3, wherein said curved arm receiving slot of said compression recoil arm, has sufficient length to permit about full closure of said door when said door lock is engaged.

6. The unlocking device of claim 3, wherein said curved arm receiving slot of said compression recoil arm has a tapered width sufficient to accommodate said curved arm having an increase in width from said ball hook to said mounting base.

7. The unlocking device of claim 1, wherein said thin flat elongated resilient member has sufficient resiliency to permit said integral compression recoil arm in the operative position to deflect towards the back of said door to permit said ball hook to enter said door unlocking portion and to recoil out of operative engagement with said U-shaped member.

8. The unlocking device of claim 7, wherein said thin flat elongated resilient member is made of rolled tempered steel.

9. The unlocking device of claim 3, wherein said each of said compression recoil arm finger members extend longitudinally from said compression recoil arm fulcrum corner in an arch.

10. The unlocking device of claim 3, wherein the distal end of each of said compression recoil arm members is retroverted in operative position back towards the catch mounting base.

11. The unlocking device of claim 1, wherein said compression recoil arm fulcrum corner forms a longitudinal fulcrum corner interior angle of from about 140 degrees to about 150 degrees between said side of door arched contact portion and said compression recoil arm when not in operative engagement with said door lock.

12. The unlocking device of claim 1, wherein said door stop contact corner forms a longitudinal door stop corner interior angle of from about 80 degrees to about 90 degrees between the front of door contact portion and said side of door arched contact portion.

13. The unlocking device of claim 1, wherein said handle portion longitudinally diverges from said front of door contact portion at an angle of from about 30 degrees to about 45 degrees.

14. The unlocking device of claim 1, wherein said handle portion has an offset grip portion with a width less than said front of door contact portion for providing ease in grasping said tool.

15. The unlocking device of claim 3, wherein said one finger member and other finger member each have a length about equal to the length of said door locking portion of said U-shaped member.

16. The unlocking device of claim 14, wherein said offset grip portion of said handle portion carries a hand protective layer.

* * * * *